United States Patent [19]

Bolton et al.

[11] Patent Number: 4,934,228

[45] Date of Patent: Jun. 19, 1990

[54] SYSTEM FOR DIVERTING VENEER SHEETS HAVING OFFSIZE DEFECTS

[75] Inventors: William E. Bolton; John C. Holbert, both of Corvallis; Jeffrey D. Ballance, Albany, all of Oreg.

[73] Assignee: U.S. Natural Resources, Inc., Portland, Oreg.

[21] Appl. No.: 297,603

[22] Filed: Jan. 13, 1989

[51] Int. Cl.[5] ..... B26D 7/06; B27B 1/00

[52] U.S. Cl. ..... 83/23; 83/106; 83/365; 83/370; 118/37; 118/42; 118/670; 144/2 R; 144/3 R; 144/209 R; 144/356; 144/367; 156/64; 156/378

[58] Field of Search ..... 156/64, 378, 379; 83/365, 367, 370, 371, 105, 106, 107, 23; 118/37, 40, 42, 668, 670; 144/3 N, 3 R, 356, 357, 367, 209 R

[56] References Cited

U.S. PATENT DOCUMENTS

| | | | |
|---|---|---|---|
| 2,379,682 | 7/1945 | Colucci et al. | 83/365 |
| 3,093,020 | 6/1963 | Walsh | 83/106 |
| 3,169,428 | 2/1965 | Owen | 83/27 |
| 3,199,555 | 8/1965 | Hildebrand | 144/3 R |
| 3,264,917 | 8/1966 | Califano et al. | 83/94 |
| 3,329,181 | 7/1967 | Buss et al. | 83/365 |
| 3,461,759 | 8/1969 | Dixon et al. | 83/365 |
| 3,547,170 | 12/1970 | Maxey | 83/371 |
| 3,560,096 | 2/1971 | Watson et al. | 83/371 |
| 3,566,937 | 3/1971 | Erickson | 144/3 R |
| 3,591,279 | 7/1971 | Gardner | 355/29 |
| 3,760,667 | 9/1973 | Makey | 83/362 |
| 3,866,498 | 2/1975 | Jarman | 83/89 |
| 4,397,204 | 8/1983 | Colombo | 83/371 |
| 4,606,387 | 8/1986 | Weislogel et al. | 144/3 N |
| 4,700,758 | 10/1987 | Bernath | 83/365 |
| 4,726,271 | 2/1988 | McEwan | 83/155 |
| 4,781,090 | 11/1988 | Feldkamper et al. | 83/371 |
| 4,809,574 | 3/1989 | Cremona | 83/371 |

*Primary Examiner*—W. Donald Bray
*Attorney, Agent, or Firm*—Robert L. Harrington

[57] ABSTRACT

A system for detecting offsize defects and for segregating the veneer sheets containing the defects from the non-defective sheets. Scanners are positioned along the in-feed conveyor leading to the clipper. As offsize defects are identified, a computer determines which of the sheets to be cut will contain the defects. These sheets are segregated as by diverting them to a pull chain conveyor following the cutting of the sheets from the continuous sheeting. Dye is sprayed on the area of the defects as detected by the scanners to aid in further handling of the defective sheets when removed from the pull chain.

9 Claims, 2 Drawing Sheets

SYSTEM FOR DIVERTING VENEER SHEETS HAVING OFFSIZE DEFECTS

FIELD OF THE INVENTION

This invention relates to a system for detecting offsize defects in veneer and for segregating sheets containing such defects.

BACKGROUND OF THE INVENTION

Plywood which is used extensively in the building trade, is produced from stacked and laminated sheets of veneer. For example, a 4'×8' five ply sheet of plywood ⅝" thick may be produced from five separate 4'×8' veneer sheets, each being ⅛" thick, stacked one on top of the other and glued together. Certain of the inner ply layers may be produced from butted partial veneer sheets, e.g. two veneer half sheets of 2'×8' or two veneer sheets of 4'×4', etc., which in any event make up a full inner ply of 4'×8'. For the sake of accuracy, when making up the sheets of plywood, the dimensions are 54"×102" (or 27"×102" for half sheets) which are subsequently trimmed back to 4'×8' sheets.

The above dimensions are the most common for wood veneer used to produce plywood sheets. However, they are but examples of the product that is produced in a veneer peeling process to which the present invention is applicable. As already explained, when reference is made to 4'×8' sheets, the reader should understand that a full sheet of veneer or plywood is intended and in the pre-trimmed stage, those dimensions will actually be 54" ×102". Similarly, as related to the uncommon production of plywood having totally different dimensions (e.g. 5'×9'), those different dimensions can be substituted for the 4'×8' dimensions in the described examples.

The process of producing the individual veneer sheets for the examples given, typically involves the peeling of a continuous sheeting of veneer from an 8' block, thus producing an 8' wide continuous sheeting. Other block lengths of 4', 6' and 10' are, however, also peeled for veneer sheeting and this invention is not limited to any particular block length or to a particular width or even length of veneer sheet to be produced from the different block lengths. The continuous sheeting of veneer is directed through a clipper that cuts the veneer to a desired sheet length, e.g. of 4', thus producing the common 4'×8' full sheets. Note, as concerns the sheet handling process, that the length dimension of the sheet is considered herein to be the direction of sheet movement, and the width dimension is considered to be the side edge to side edge dimension, thereby producing a sheet that is 8' wide and 4' long.

Whereas the peeling and handling of veneer sheeting (continuous) and veneer sheets (individual) has been largely automated, one area that has continued to plague veneer producing mills is the occurrence of offsize defects in the sheeting. An offsize defect is a change in thickness. Such a defect occurs when in effect, the peeling knife digs in too deep or lifts away from the block being peeled. There are many situations that cause such erratic behavior during the peeling operation. Whereas considerable attention is paid to avoid these situations, the defects nevertheless do occur and when they do, unless detected and removed, they will result in the production of flawed plywood. The occurrence of a defect in the sheeting must be accommodated in the downstream handling of the veneer sheets.

This problem of offsize defect is to be distinguished from defects such as cracks, knot holes and the like where there is some portion missing from the sheeting of veneer. Such defects are typically detected by a light bar projected across the width of the veneer sheeting. A light detector on the opposite side of the sheeting will "see" the light projected through any opening in the sheet and will activate the clipper to cut out the flaw. Of course, such a detector (e.g. an occlusion type scanner) cannot detect offsize defects. It is the objective of the present invention to detect offsize defects as differentiated from breaks or openings through the sheeting.

Returning to the detection of offsize defects, the automatic production of plywood depends on a consistent thickness of the veneer sheets. If sheets having offsize defects are introduced into the plywood laminating process, the plywood will end up with depressions or bulges at the cross section of the offsize defect, either of which is unacceptable.

The presence of even a small percentage of defective plywood produced by a mill can be enormously expensive and is to be avoided. Accordingly, it is highly desirable that defective veneer sheets be pulled out of the plywood producing process before it reaches the lamination stage of production. A single defect in one veneer sheet that is laminated into a plywood sheet will reduce the entire five sheets of veneer to near worthless scrap. The stacking, drying and peeling operations are, of course, wasted.

Detection and removal of the defective veneer sheet will not only save the other four veneer sheets and avoid the wasted gluing step, but the defective sheet may even be partially saved by trimming out the defective portion. It is therefore an object of the present invention to automatically detect and mark the location of the offsize defects and in response thereto, automatically divert sheets containing such defects for subsequent processing.

SUMMARY OF THE INVENTION

The preferred embodiment of the present invention involves the utilization of reflective beam scanners placed in the path of the continuous sheeting as that sheeting is being directed into the clipper (where the sheeting is cut into individual sheets). A veneer sheet diverter is placed in the path of the sheets following the clipper and that diverter, at least in part, is under the control of a computer.

The scanners are arranged and operable to detect the presence of offsize defects in the sheeting. The rate of movement of the sheeting past the scanner and into the clipper is monitored by the computer. The distance between the clipper and the scanner is known. The clipper is coordinated with the sheeting movement to normally cut the sheeting into 4' lengths but in any event, the cutting action of the clipper is also monitored by the computer. Upon detection of a defect by the scanner, the computer can determine when the defect will reach the diverter and actuate the diverter to remove that sheet of veneer which contains the defect. An alternate embodiment provides the computer with direct control over the clipper to reduce the amount of defect free sheeting that is diverted, e.g. by clipping the sheeting out of sequence immediately following the defect rather than running a full 4' length. The 4' clipping sequence is simply started anew.

An accessory to this operation is a visible marking device such as a paint sprayer, positioned immediately following the scanners. As a scanner detects an offsize defect, it activates the paint sprayer. The diverter diverts the defective sheet to a pull chain. These sheets are then manually trimmed to remove the areas of defect as indicated by the markings.

The preferred embodiment generally described above is more specifically described in the following detailed description having reference to the accompanying drawings.

DETAILED DESCRIPTION OF THE PREFERRED EMBODIMENT

Figure 1:
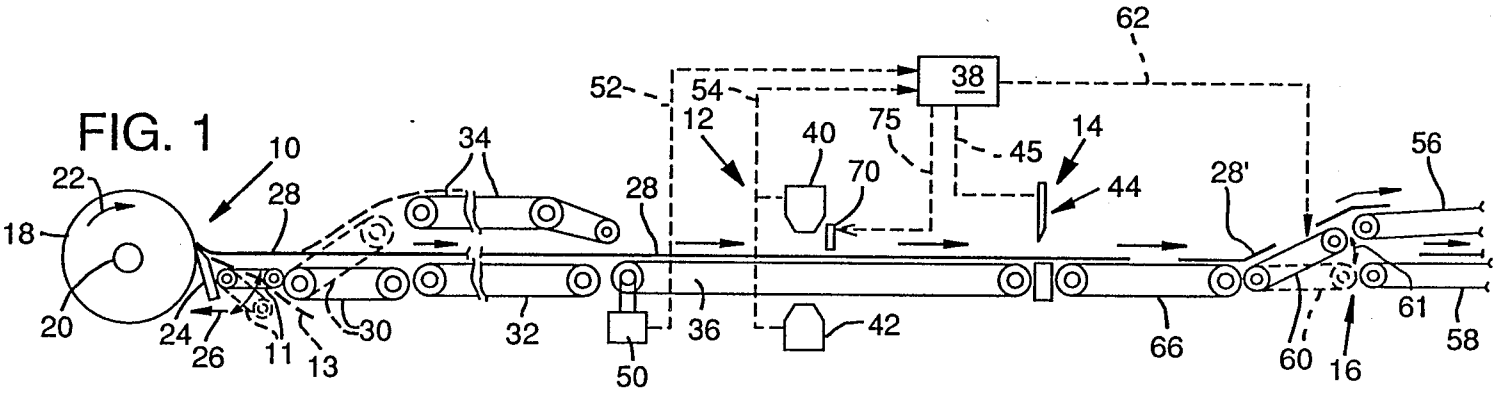
FIG. 1 is a schematic illustration of a veneer mill operation including veneer peeling, scanning, clipping and defective veneer sheet diverting, all in accordance with the system of the invention.

Reference is made to FIG. 1 wherein there is represented a veneer peeling operation 10, a defect detecting operation 12, a clipping operation 14 and a sheet diverting operation 16.

A peeling block 18 (e.g. an 8′ long log) is rotated about a longitudinal axis 20. While rotated, a peeling knife 24 is urged toward the block 18 as indicated by arrow 26. The long straight-edged knife 24 (e.g. at least 8′ long) is presumably rigid and its rate of movement into the block 18 is carefully controlled with its cutting edge always maintained parallel to the axis 20. The peeling spindles which generate axis 20, rotate the log into the cutting edge of the knife as indicated by arrow 22. A continuous sheeting 28, e.g. of 0.1 inch thick veneer, as determined by the rate of knife movement, is peeled from the block.

A "roundup" operation will generally precede the peeling of veneer. In the roundup operation, a block is peeled down to a near cylindrical configuration, i.e. that configuration that will result in the peeling of usable veneer. During "round up" peeling, the humps and bumps that project from the log surface are peeled off as short strips 13. The short strips 13 have no value as veneer and they are simply discarded as scrap material, e.g. by a trash gate 11 which diverts the scrap material to a conveyor to be conveyed to a chipper.

For the majority of the peeling operation following "roundup", a consistent 0.1 inch thick sheet is produced. However, from time to time something will happen to cause either the knife edge to be deflected (e.g. when the knife contacts a knot) or a shifting of the log in the spindles (e.g. when it gets small enough to flex or bend), resulting in a thickness variation in the veneer being peeled. This thickness variation is referred to herein as an offsize defect. This offsize defect can cover the full width of the sheeting or it may be localized. It can extend over a very short section in sheeting length or it can be quite long. In any event, it is highly desirable to determine where and to what extent that defect is present on the sheeting and prevent the defect from being incorporated into the operation wherein veneer sheets are assembled into plywood.

The sheeting 28 is conveyed away from the peeling operation on a conveyor 30. Conveyor 30 and the subsequent conveyors leading up to the clipping operation 14, may be arranged in a variety of different conveyor configurations. A series of several conveyors in succession may be employed or, as illustrated, a series of stacked conveyors 32, 34 may be employed. The configuration is not important to this invention; except to provide the reader with an appreciation that these conveyor systems are used to stockpile the veneer. The clipping operation 14 is slower than the peeling operation 10 but the clipping operation is not subject to the frequent interruptions that occur in the peeling operation. Thus, while the peeling lathe is operating, it generates a stock pile of the veneer on the intermediate conveyors. When the peeling lathe is stopped, the clipper continues to operate with the conveyors being appropriately controlled to feed the stock piled sheeting into the clipping operation 14. Restart of the peeling lathe once again produces sheeting that is rapidly fed through the conveyor system in a catch up mode of conveyance until the end of the previously peeled sheeting is reached. The stock piling of the sheeting is then commenced.

The system as described to this point is not new and need not be explained in any greater detail. It is sufficient to note that the continuous sheeting is directed from the peeling operation 10 through a suitable conveyor system and onto a clipper in-feed conveyor 36. The in-feed conveyor 36 conveys the sheeting 28 through the offsize detecting operation 12 and into the clipping operation 14 at a known rate of travel (i.e. known to the computer 38). As previously mentioned, a further defect detecting operation immediately preceding the clipping operation may be employed (for detecting holes in the sheeting), but such is not shown or considered a part of this invention. Its presence is acknowledged as a probable component of the overall operation of the system.

Figure 3:
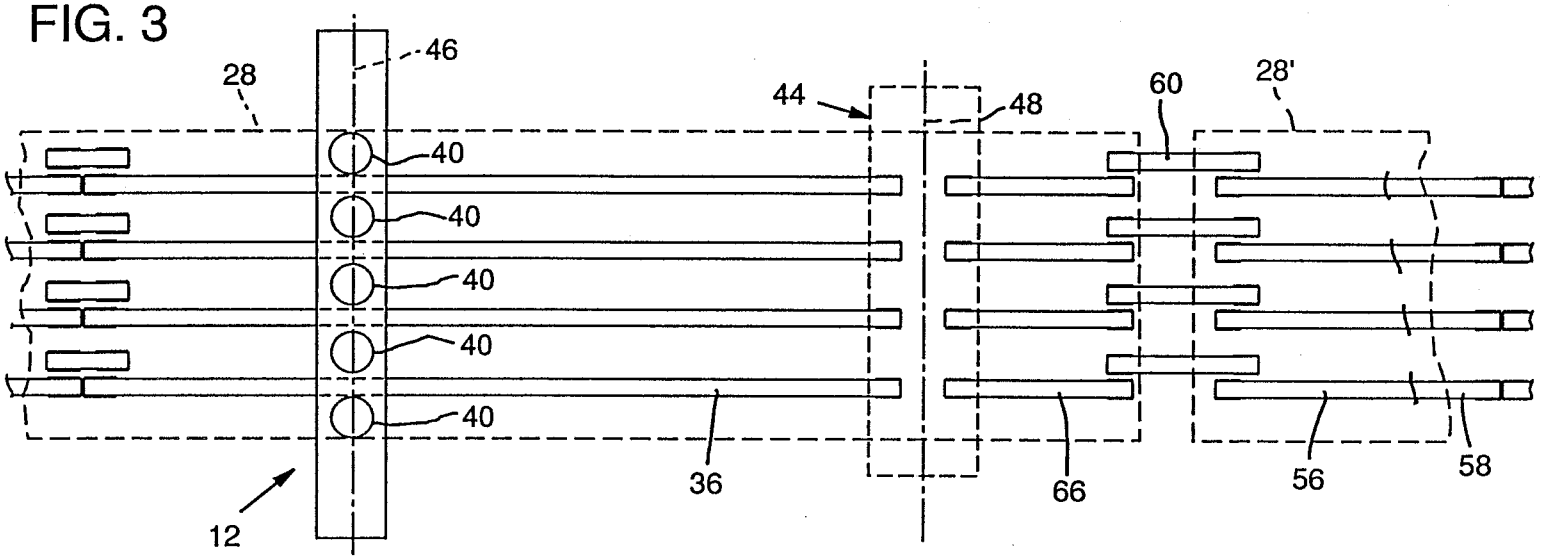
FIG. 3 is a plan view of the apparatus of FIG. 2.
Figure 2:
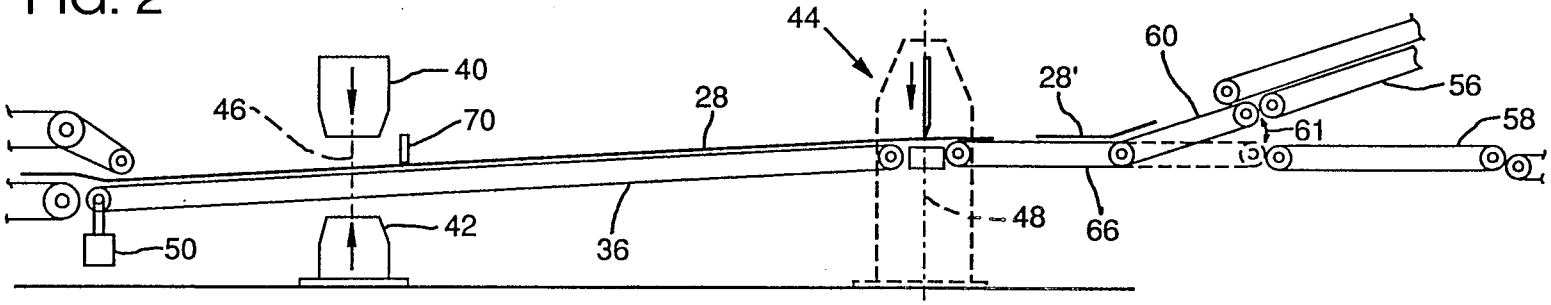
FIG. 2 is a view in elevation of the scanner, clipper and sheet diverter of the system of FIG. 1.

Reference is now also directed to FIGS. 2 and 3 wherein the detecting and clipping apparatus is shown in greater detail. Positioned at a known position along the reach of the conveyor 36, is the scanning station 12 which includes an upper optical scanner 40 and a lower optical scanner 42. These scanners are reflective beam scanners well known to the art as illustrated by the following patent(s):

Pirlet, U.S. Pat. No. 3,610,754; Kerr,
U.S. Pat. No. B13,671,726; and
Morander, U.S. Pat. No. 4,375,921.

The application of the scanners in accordance with the present invention is indeed believed to be novel but the operation of the scanner is not new. In the present application of the reflection beam scanners, a pair of scanners are coupled together at each of a plurality of locations along the width of the veneer sheets (five pairs are indicated in FIG. 3). The scanner herein contemplated is capable of projecting a light beam onto a surface and through computer analysis of the reflected beam, a distance from the surface, whereat the beam is projected, and the scanner is precisely determined. The scanner position is calibrated to a known position in space and thus the surface position of the veneer is determined.

The scanners 40 are positioned on one side (the top) and scanners 42 directly in line with and on the opposite side (the bottom) of the veneer sheet 28. The paired scanners are calibrated to a common position so that the surface positions directly opposite one another on the veneer sheet are determined relative to each other. A computer can thus determine the exact thickness of the veneer at the precise location on the sheet between the projected light beams. It can also determine the vertical position of the sheet. It will be appreciated that vertical movement of the sheet will not interject errors. Thus, as illustrated in FIGS. 2 and 3, scanners 40 and 42 identify precisely the vertical (Y axis) positions of the respective upper and lower surfaces of the veneer sheeting at each of the lateral positions (X axis) of the coupled scanners across the sheeting width, (located between the conveyor belts of conveyor 36 as indicated in the plan view of FIG. 3). As the continuous sheeting 28 passes between the scanners, readings are taken at frequent intervals, i.e. as deemed desirable to insure adequate detection of offsize defects that are likely to occur as a result of errant peeling in the peeling operation 10.

The clipper 44 of clipping operation 14 is spaced downstream from the scanners at any known distance, as measured between the position at which the scanner readings are taken to the position of cutting by the clipper 44. These positions are indicated by center lines 46 and 48, respectively, on the drawings of FIGS. 2 and 3. The movement of the in-feed conveyor is tracked by an encoder 50 connected to a pulley positioned at the end of the in-feed conveyor 36. Whereas the conveyor may be simply driven at a desired speed and that speed input to the computer 38, it is preferable to use the encoder 50 which monitors the pulley rotation and through it the conveyor movement. The encoder output is conveyed to the computer 38 as indicated by dash line 52 in FIG. 1.

The detection of an offsize defect by the scanners 40, 42 is also conveyed to the computer 38 as indicated by dash line 54 in FIG. 1. That is, the computer is programmed with parameters including an acceptable deviation in thickness and an acceptable surface area of thickness variation for the veneer sheet, and detection of a sheet condition outside those parameters will be identified by the computer as an unacceptable defect. Also, as desired, closely spaced vertical deviations in the sheets (like corrugations in the sheeting as differentiated from variations in sheet thickness) may also be considered defects with parameters of acceptability. When a defect is detected, the computer keeps track of the position of the defect as it moves along the conveyor 36.

The clipper 44 is designed to cut the sheeting 28 into individual veneer sheets 28′. Again, this can be accomplished by activating the clipper in response to the actual passage of veneer as enabled by an encoder as previously described, e.g. encoder 50. Such control for cutting the desired sheet length exists in prior systems and is not specifically disclosed herein.

The sheet diverting operation 16 following the clipping operation 14 is comprised of a stacker in-feed conveyor 56, a pull chain conveyor 58 and a diverting conveyor 60. The diverting conveyor 60 is pivoted as indicated by arrow 61 in FIGS. 1 and 2, to direct the sheets 28′ to either of the conveyors 56 or 58. The pivoting of the diverting conveyor 60 is controlled by a primary and a secondary control schematically illustrated in FIG. 5.

Figure 5:
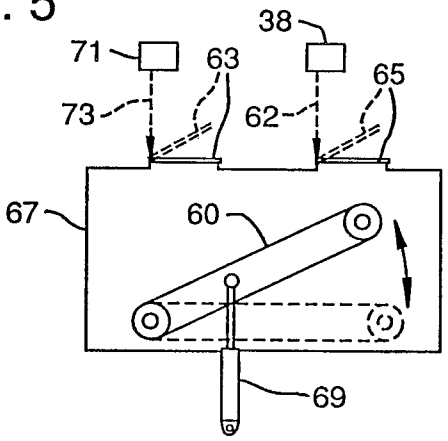
FIG. 5 illustrates schematically the control circuitry for the specific operation of the diverter of FIG. 1.

Referring to FIG. 5, the primary control is that which has been in existence prior to the invention and is illustrated by dash line 73 from control box 71 controlling switch 63 in circuit 67. In effect the circuit 67 is closed during normal operations (switch 63 and switch 65 both being closed). In the closed position as illustrated, defect-free sheets are being clipped by clipper 44 from the sheeting 28 and directed by conveyor 66 and pivotal conveyor 60 onto conveyor 56 for conveyance to the stacking operation.

The primary control of prior systems function to control the diversion of sheets having breaks or holes. When such a defective sheet is detected, as that sheet approaches conveyor 60 the control switch 63 is opened. The circuit 67 is thereby broken and cylinder 69 is activated to pivot conveyor 60 to divert the sheet to conveyor 58.

The secondary control, i.e. the dash line 62 from computer 38 is adapted for diverting sheets having offsize defects in accordance with the present invention. The secondary switch 65 opens the circuit 67 independent of switch 63, i.e. in response to control signal 62 from the computer 38. Switch 65 is thereby opened to cause conveyor 60 to pivot to the position for diverting the sheet containing the offsize defects to conveyor 58.

The conveyor system following the clipper 44, which includes conveyor 66 between clipper 44 and diverting conveyor 60, is run at a substantially higher speed than the conveyor system leading to the clipper, e.g. conveyor 36. Thus, as each sheet 28′ is clipped from the sheeting 28, it is rapidly separated from the end of the sheeting 28. This rapid separation as between the clipped sheets on conveyor 66 enables the diverting system to more readily discriminate as between the sheets, which otherwise would be in end-to-end abutment. It will be understood that if the conveyor 66 is moving twice the speed of conveyor 36, the sheets will be separated by the sheet length (the separated sheet 28′ will travel 8′ along conveyor 66 while the sheeting 28 is held back by conveyor 36 to a 4′ movement in the same time span), at which point the clipper will be activated for producing the following 4′ long sheet and it, too, will then be conveyed at the faster rate.

The action of the diverting conveyor 60 is desirably coordinated with the action of clipper 44. In a specific example of a system of the invention, the conveyors 66 and 60 have a combined length of nine feet. Thus, when the clipper cuts a sheet, the preceding sheet has just about passed the full 9′ length of the conveyors 66 and 60. That is, assuming a 4′ space between the sheets and that the about-to-be-clipped sheet extends 4′ past the clipper 44, the trailing edge of the preceding sheet is 8′ from the clipper and just 1′ from being passed off of the 60. Thus, as a sheet 28′ is about to be clipped free of the sheeting 28, and assuming that computer 38 has determined that that sheet is defective, simultaneous with activation of the clipper 44 the diverting conveyor 60 is pivoted to its lower position (by opening the circuit 67 through activation of switch 65). The defective sheet is thus directed to the pull chain conveyor 58, i.e. the dash line position as seen in FIGS. 1, 2 and 5 The remaining 1′ length of the preceding sheet will be pulled along with conveyor 56 during the time that the diverting conveyor 60 is repositioned.

Figure 4:
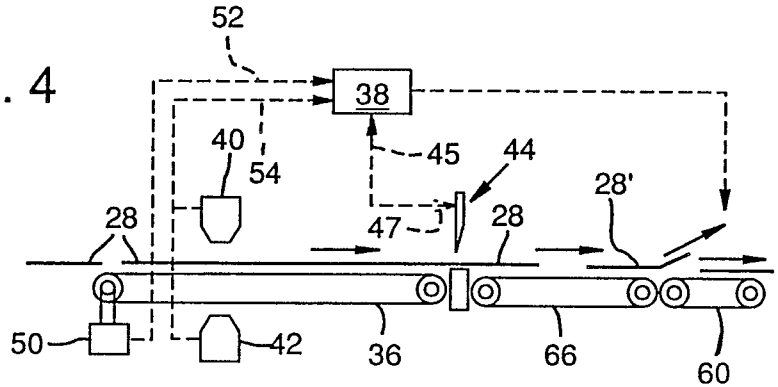
FIG. 4 illustrates schematically the control circuitry in general for the operations illustrated in FIG. 1.

Reference is now made to FIG. 4 which is a schematic of the control functions for accomplishing the diverting action of the apparatus as just explained. As illustrated, the computer 38 gathers information from the scanners 40, 42 (control line 54), from the encoder 50 of conveyor 36 (control line 52) and from the clipper 44 (control line 45). The conventional control for clipper 44 monitors the movement of the sheeting 28, e.g. through encoder 50, and simply severs the sheeting 28 into usable lengths 28′ as determined by that known movement.

When the computer 38 is advised of an offsize defect, it observes the position of the defect on the sheeting relative to the leading edge of the sheeting. It knows the location of the leading edge because it knows when the last cut was made, the movement of the sheeting since the last cut, and the distance between the clipper and the scanners 40, 42 (between center lines 46 and 48 from FIG. 2). It knows the relative position of the defect simply by following the distance of travel of the sheeting since the defect was detected.

Assuming that the distance between center lines 46 and 48 is established to be 15′, the distance from the leading edge of sheet 28 to the scanners at any given instant must be between 19′ and 15′, i.e. the distance from line 46 to line 48 (15′) plus the distance moved since the clipper was last activated (assuming that 4′ is the maximum distance permitted between cuts). Assume a defect that stretches along the sheeting length a distance of 2′. The defect is noted to start at a point 19′ from the leading edge and continues for 2′. Note that the computer will determine that the clipper will cut defect-free sheets at intervals of 4′, 8′, 12′ and 16′ from the leading edge. The next cut thereafter will be 1′ after the start of the defect, i.e. at the 20′ mark. The defect will be present for the last foot of the sheet and continue one foot into the next sheet. (If the defect is detected 17′ from the leading edge, the entire two feet of defective length will appear on one sheet. That is, using the same interval calculation, the defect will start one foot from the leading edge of one sheet and stop one foot short of the leading edge on the next sheet.)

The computer task is a simple one. It keeps track of the clipping action until it knows that a sheet having a defect has just been severed from the sheeting. It simultaneously signals the diverter 60 to pass the sheet to the pull chain, i.e. it opens the switch 65 in the control circuit thereby causing the conveyor 60 to pivot into line with conveyor 58.

As previously described, the computer and control system of FIG. 4 which is responsive to offsize defects, assumes no control over the clipper. It simply monitors the clipping action. The clipper cuts whatever length it cuts and the computer 38 determines which of the sheets are defective and diverts the defective sheets to the pull chain. The defective sheets are then pulled from the line and manually cut into partial sheets if there is enough non-defective sheeting to be salvageable, or scrapped if not. A paint or dye can be sprayed on the sheeting (by paint nozzle 70 in FIG. 1 activated through control line 75 by the computer 38). The pull chain operator simply determines how the sheet can be cut by observing the paint or dye markings.

A variation to the control system of FIG. 4 is to provide direct control of the clipper 44 by the computer 38 which is indicated by the dashed arrow head 47 of control line 45. (In this event, it may be desirable for computer 38 to respond also to the occlusion scanners as well as the offsize defects, i.e. merging the control needs of the primary control 71, 73 in FIG. 5 with computer 38.) For this alternate embodiment, it is contemplated that if the sheeting is cut at the beginning and end of every detected defect as directed by computer 38, then two further advantages can be realized. The pull chain operator can be saved the job of cutting up the defective sheets, and additional full-length (or half length) defect-free sheets may be salvaged.

For example, in a situation where there is a sequence of one foot long defects starting at the leading edge and continuing at four foot intervals. The total length involved would be 24′. The operation of the clipper uncontrolled by computer 38 will cut six sheets at 4′, 8′, 12′, 16′, 20′ and 24′ intervals. The defects will appear on sheet one (the first foot of that sheet), sheet two (the second foot), sheet three (the third foot), sheet four (the fourth foot), sheet five would be clear and sheet six would be defective for the first foot. Under the controlled condition proposed for this alternative, the one foot lengths would each be cut out and the same 24′ of sheeting length would produce five instead of one full defect-free sheet. Note also that no follow up cutting or trimming is needed.

Whereas the example above may not be a very likely situation, it does illustrate that additional full sheets can be salvaged from the additional control of having computer 38 simply cut out the defective segments, and even a small percentage of increase in production will likely quickly return the additional cost of obtaining that control.

A further modification may be to provide for diversion of the defective sheets at the point of stacking the sheets. Thus the sheets containing the offsize defects may be carried on down the conveyor 56 and whereas a stacker typically stacks the sheets into various categories (moisture content, size, etc.), a new category for offsize defective sheets would be created and the offsize sheets would be segregated into a separate stack. Of course the defective sheets would have to be tracked by the system and identified to the stacker. It is even possible for the computer and scanner to discriminate as between the types of offsize defects and to segregate the sheets accordingly, e.g. some by the diverter following clipping as described and some at the stacker or as a further alternative by multiple bins at the stacker The invention as identified herein is believed directed to the concept of combining scanners, clipper, sheeting conveyor and diverter with computing to enable the diversion of offsized sheets out of the automatic production of plywood. This concept of control and coordination produces a significant benefit to plywood producing mills by eliminating defective veneer sheets from the plywood manufacturing process.

The invention also offers the opportunity to intentionally produce sheeting of different thicknesses. For example, as a block is peeled down to a small diameter, the quality of the veneer being produced may not be considered satisfactory for veneer facing. An election may be made to peel the veneer to the thickness of two plys, for example, to be placed between two facing sheets as a single layer to make up a replicate of a four ply veneer sheet. The detection and diversion combination of the present invention will enable the detection of the point of conversion to the double thick ply and the diversion of the subsequently clipped double thick sheets to that special use. This may be considered a form of offsize defect detection and diversion and is particularly compatable with the above-mentioned segregation of the sheets at the stacker.

The invention is also applicable for detecting roughness as a defect. That is, if the surface becomes roughened as when the block vibrates in the spindles, this rough surface can be detected just as the previously described offsize thickness, and handled accordingly. It is to be understood, therefore, that the term offsize defect is intended to encompass detection of abnormal thicknesses in general including, e.g. the desirable double thicknesses of veneer for inner ply use, the detection of the undesirable increase or decrease of thickness due to blade deflection, and the latter noted roughness in cut.

The invention is not limited to the specific embodiments disclosed but instead encompasses the scope of the claims appended hereto.

We claim:

1. In a veneer handling process, apparatus for detecting and segregating defective veneer sheets produced from continuous sheeting of veneer comprising;

a clipping means for clipping continuous sheeting of veneer into veneer sheets of a determined dimensional length, an in-feed conveyor means for conveying the sheeting along a path into the clipping means, and movement monitoring means for monitoring the in-feed movement of the continuous veneer sheeting being conveyed to the clipping means;

detecting means positioned along the path of in-feed conveyance of the veneer sheeting at a known distance preceding the clipping means, said detecting means comprised of a plurality of thickness variation detectors spaced along the width of the sheeting, each detector individually detecting thickness variation of the sheeting in a discriminate area and thereby detecting offsize defects in the veneer sheeting, and veneer sheet conveying means for receiving veneer sheets produced by the clipping means for conveying the sheets along a path, said path leading to a sheet segregating means for selectively segregating sheets conveyed along said path as between defective and non-defective sheets, and computing means in communication with said movement monitoring means and detecting means, and control means responsive to said computing means for controlling said sheet segregating means, and said computing means determining from said communication from the detecting means and monitoring means the sheets that contain offsize defects and through said control means, segregating the defective sheets from the non-defective sheets.

2. Apparatus as defined in claim 1 wherein the segregating means is a diverting means interrupting the sheet conveying means, said control means controlling said diverting means for diverting said sheets from the path of said conveying means.

3. Apparatus as defined in claim 1 wherein each detector of the detecting means is a coupled pair of reflective beam scanners positioned in alignment on opposite sides of the path of the sheeting for determining the vertical position of each side of a respective discriminate area of the sheeting and thereby detecting thickness variations in the sheeting.

4. Apparatus as defined in claim 2 wherein the sheet diverting means is a known distance from the clipping means and said veneer sheet conveying means conveys the veneer sheets at a known rate of movement, said computing means monitors the clipping action of the clipping means whereby the computing means determines when the sheet diverting means is to be activated to divert the defective sheet being clipped from the veneer sheeting.

5. Apparatus as defined in claim 1 wherein the clipping action of the clipping means is controlled by the computing means for selective clipping of the sheeting following a detected defect.

6. Apparatus as defined in claim 1, including a marking means positioned in the path of in-feed conveyance following the offsize detection means for visually marking the sheeting at the area of defect and thereby enabling visual identification of the location of the offsize defects in the sheeting.

7. A method of automatically detecting and diverting defective veneer sheets out of a veneer handling process which comprises;

conveying a continuous sheeting of veneer along a known path at a known rate of movement, automatically scanning the sheeting at a position along the path at aligned positions on opposite sides of the sheeting and at spaced positions along the width for determining variations in the sheeting thickness at discrete areas spaced along the width and determining thereby offsize defects in the sheeting, and conveying the information therefrom to a computer, clipping the sheeting into veneer sheets at a position along the path following the scanning thereof and at a known distance from said scanning, accumulating in a computer the information of offsize defects, the rate of sheeting movement, and relative position of scanning and clipping, and computing therefrom which sheets contain offsize defects, and automatically segregating said defective veneer sheets from the defect-free sheets.

8. A method as defined in claim 7 wherein segregating the defective veneer sheets is accomplished by diverting said defective sheets from the path to be separated from the defect-free sheets continuing down said path and including monitoring the clipping of the sheeting into veneer sheets and further accumulating the information of the sheets being clipped for determining the step of diverting.

9. A method as defined in claim 7 which includes controlling the step of clipping for clipping the sheeting selectively before and after a detected defect in the sheeting.

* * * * *